US006145334A

United States Patent [19]

Mochizuki et al.

[11] Patent Number: 6,145,334

[45] Date of Patent: Nov. 14, 2000

[54] SEPARATE TYPE AIR CONDITIONER

[75] Inventors: Koji Mochizuki, Kusatsu; Mitsuo Nakanuma, Shiga, both of Japan

[73] Assignee: Matsushita Electric Industrial Co., Ltd., Osaka, Japan

[21] Appl. No.: 09/171,426

[22] PCT Filed: Feb. 17, 1998

[86] PCT No.: PCT/JP98/00653

§ 371 Date: Oct. 19, 1998

§ 102(e) Date: Oct. 19, 1998

[87] PCT Pub. No.: WO98/36225

PCT Pub. Date: Aug. 20, 1998

[30] Foreign Application Priority Data

Feb. 17, 1997 [JP] Japan ..... 9-031970

[51] Int. Cl.[7] ..... F25D 23/12

[52] U.S. Cl. ..... 62/262; 62/263; 248/200; 248/314

[58] Field of Search ..... 62/262, 263; 248/200, 248/314

[56] References Cited

U.S. PATENT DOCUMENTS

| | | | |
|---|---|---|---|
| 5,027,614 | 7/1991 | Mori et al. | 62/262 |
| 5,191,770 | 3/1993 | Kim | 62/263 |
| 5,197,299 | 3/1993 | Sohn et al. | 62/262 |
| 5,313,806 | 5/1994 | Feng | 62/295 |
| 5,421,550 | 6/1995 | Palmer | 248/200 |
| 5,582,025 | 12/1996 | Dubin et al. | 62/262 |
| 5,697,226 | 12/1997 | Marchesi | 62/263 |

FOREIGN PATENT DOCUMENTS

| | | |
|---|---|---|
| 49-20946 | 5/1972 | Japan . |
| 54-163049 | 11/1979 | Japan . |
| 58-119166 | 8/1983 | Japan . |
| 2-114829 | 9/1990 | Japan . |

*Primary Examiner*—William Doerrler
*Assistant Examiner*—Mark Shulman
*Attorney, Agent, or Firm*—Ratner & Prestia

[57] ABSTRACT

A unit is installed easily and safely on a vertical member within hand's reach from above. An indoor unit is installed indoors and has a hook extending downward from the upper part of the back side of the indoor unit. An outdoor unit is installed outdoors to cooperate with the indoor unit. An installation member including a yoke is fitted to the vertical member with bolts. A holding part having the hook of the outdoor unit is engaged with the upper part of this yoke from above, and extended laterally for stopping it from beneath. A stopping part is provided beneath the holding part of the front side of the yoke for stopping the back side of the outdoor unit at a specified position.

28 Claims, 3 Drawing Sheets

SEPARATE TYPE AIR CONDITIONER

This Application is a U.S. National Phase Application of PCT International Application PCT/JP98/00653.

TECHNICAL FIELD

The present invention relates to a separate type air conditioner having an indoor unit installed indoors and an outdoor unit installed outdoors.

BACKGROUND ART

As shown in FIG. 3, an outdoor unit 51 of a separate type air conditioner accommodates many component devices, a heavy compressor 53 and others in a box 52 in order to decrease the components of the indoor unit not shown effectively, and reduce in weight and size. Accordingly, the outdoor unit 51 is heavier than the indoor unit, and hence generally it is installed on a bench place on the ground, verandah or roof, by making use of mounting bases 54 attached to the bottom. The mounting base 54 has a mounting hole 54*a* to the bench, and is bolted firmly. Depending on the case, however, if there is no space for placing the bench, the outdoor unit 41 is installed on the outer wall.

In such installation, hitherto, a stand 56 having a mounting part 55 to be mounted on the wall with bolts 57 as shown in FIG. 3 is used.

However, inn such conventional method of installation, the stand 56 has mounting holes 56*a* corresponding to mounting holes 54*a* of the mounting bases 54 of the outdoor unit 51, and corresponding bolts 58 passing in them and nuts 59 to be engaged with these bolts 58 are tightened to support. Such job is done, however, on an elevated place, and the mounting holes 54*a* at the heavy outdoor unit 51 side must be positioned precisely to the mounting holes 56*a* of the stand 56. Accordingly, this job is accompanied by heavy labor and is slow in progress. Or, when installing the outdoor unit 51 on a place remote from the ground, such as the outer wall of a high-rise building, a scaffold must be erected prior to installation, or the outdoor unit 51 must be lifted and suspended by a rope or the like, while such complicated job is done, which required much labor. If, by stretching out hands from within the window, if the stand 56 can be mounted on the outer wall of the building beneath the window, since the installation job of the outdoor unit 51 on the stand 56 is mainly done in the bottom of the outdoor unit 51, the worker must go out of the window to reach beneath or ahead of the outdoor unit 51, and the improvement of this working efficiency is strongly demanded.

In the light of the above problems, it is hence an object of the invention to present a separate type air conditioner capable of installing easily and safely the outdoor unit on the outer wall of the building within a reaching range of hand from above.

SUMMARY OF THE INVENTION

To achieve the object, the invention comprises an indoor unit installed indoors, an outdoor unit installed outdoors to cooperate with the indoor unit having a hook releasing downward provided in the upper part of the back side, and an installation member including a yoke fitted to the wall with bolts, a holding part having the hook of the outdoor unit engaged with the upper part of this yoke from above, and extended laterally for stopping it from beneath, and a stopping part provided beneath the holding part of the front side of the yoke for stopping the back side of the outdoor unit at a specified position.

According to the separate type air conditioner of the invention, first the installation member is fitted to the specified position of the outer wall of the building at its yoke, and it is fitted with bolts, and then the hook in the upper part of the back side of the outdoor unit is engaged with the holding part provided in the upper part of the yoke from above, and therefore the outdoor unit is suspended by the holding part and is not dropped or shaken right or left, and therefore if the position of installation is an elevated place, as far as reached by hand from the window, stairs, verandah, roof top or the like, it is possible to install easily and safely without scaffold or suspending job, and if the outdoor unit is shifted to the back side in the lower part from the holding position of the upper part of the back side, it is stopped at the specified position by the stopping part beneath the holding position of the yoke so as to be stable in an appropriate upright position, so that it can be used as it is without any problem. Besides, the stability of this upright position is higher when the outdoor unit is heavier, which is also an advantage.

When the hook of the outdoor unit is applied in one position in the lateral direction corresponding to the center of gravity of this outdoor unit, the suspending position by this hook and the holding part is the position balanced in weight to the right and left of the outdoor unit, and if suspended at one position only, the anti-deflection rigidity in the yoke plane direction is further enhanced, and a stable installation state is obtained by a simple installation work, and the installation job is easier.

By forming the hook of the outdoor unit so that the releasing part of the hook may be expanded toward the releasing end, the operation of leading the hook into the holding part of the installation member from above is easier, and moreover the engagement of the hook and the holding part at the engagement position is firm.

By forming a mounting hole of the outdoor unit at a position abutting against the back side of the outdoor unit in the installation member, and forming the mounting part having a space for inserting a bolt against the wall to pass through the mounting hole, after installing the outdoor unit as mentioned above, it is easier in the later procedure of bringing the mounting part between them by making use of the space against the wall, passing into the mounting hole of the mounting part, and tightening with screws to the back side of the outdoor unit, and deviation of position and loosening of engagement of the hook and the holding part can be inhibited, and accidental loosening or dropout of installation state of the outdoor unit can be prevented.

BEST MODE OF CARRYING OUT THE INVENTION

Figure 1:
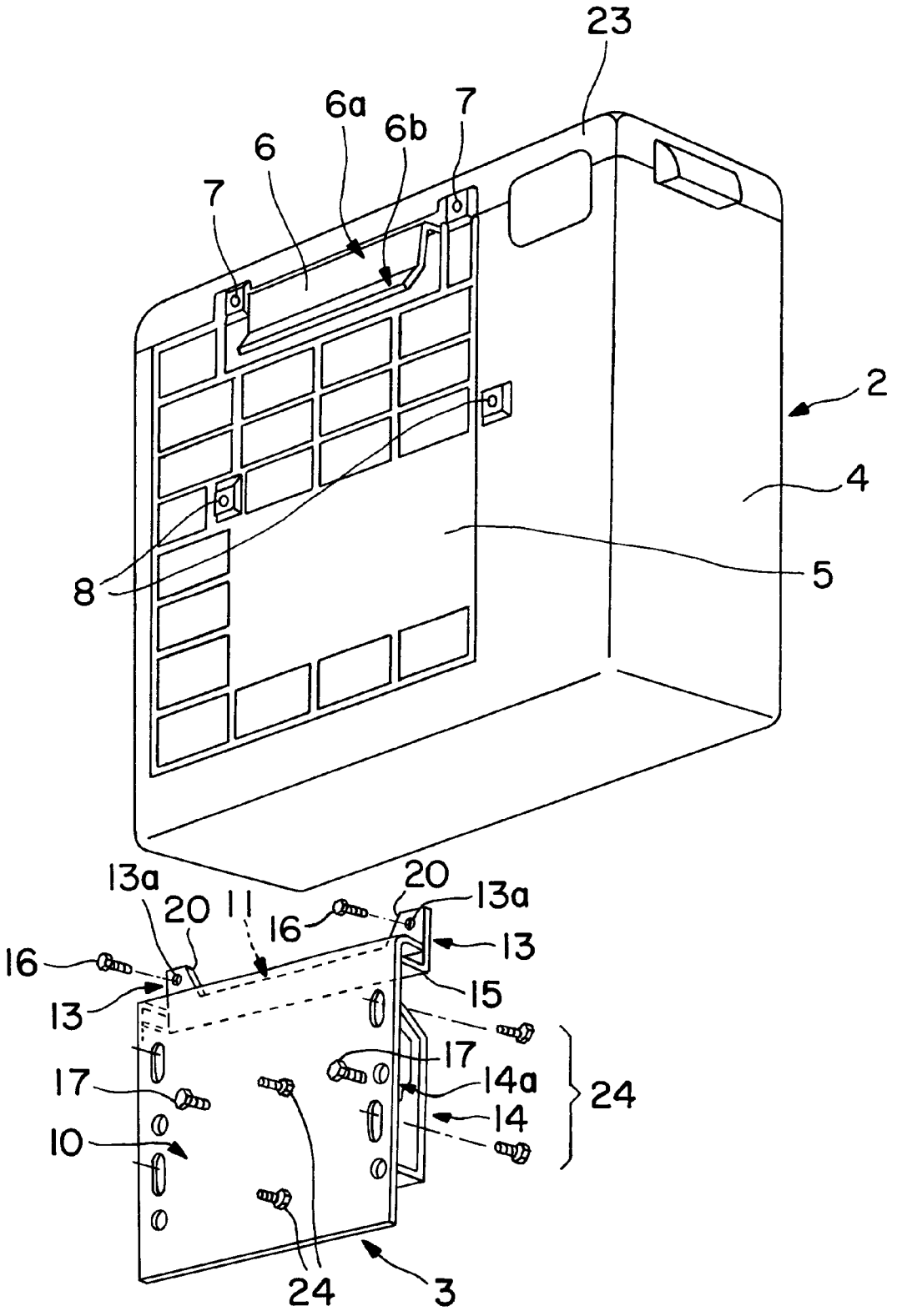
FIG. 1 is a backward perspective view showing an embodiment of outdoor unit and installation member of a separate type air conditioner of the invention.

An embodiment of the invention is described below while referring to the drawings.

Figure 2:
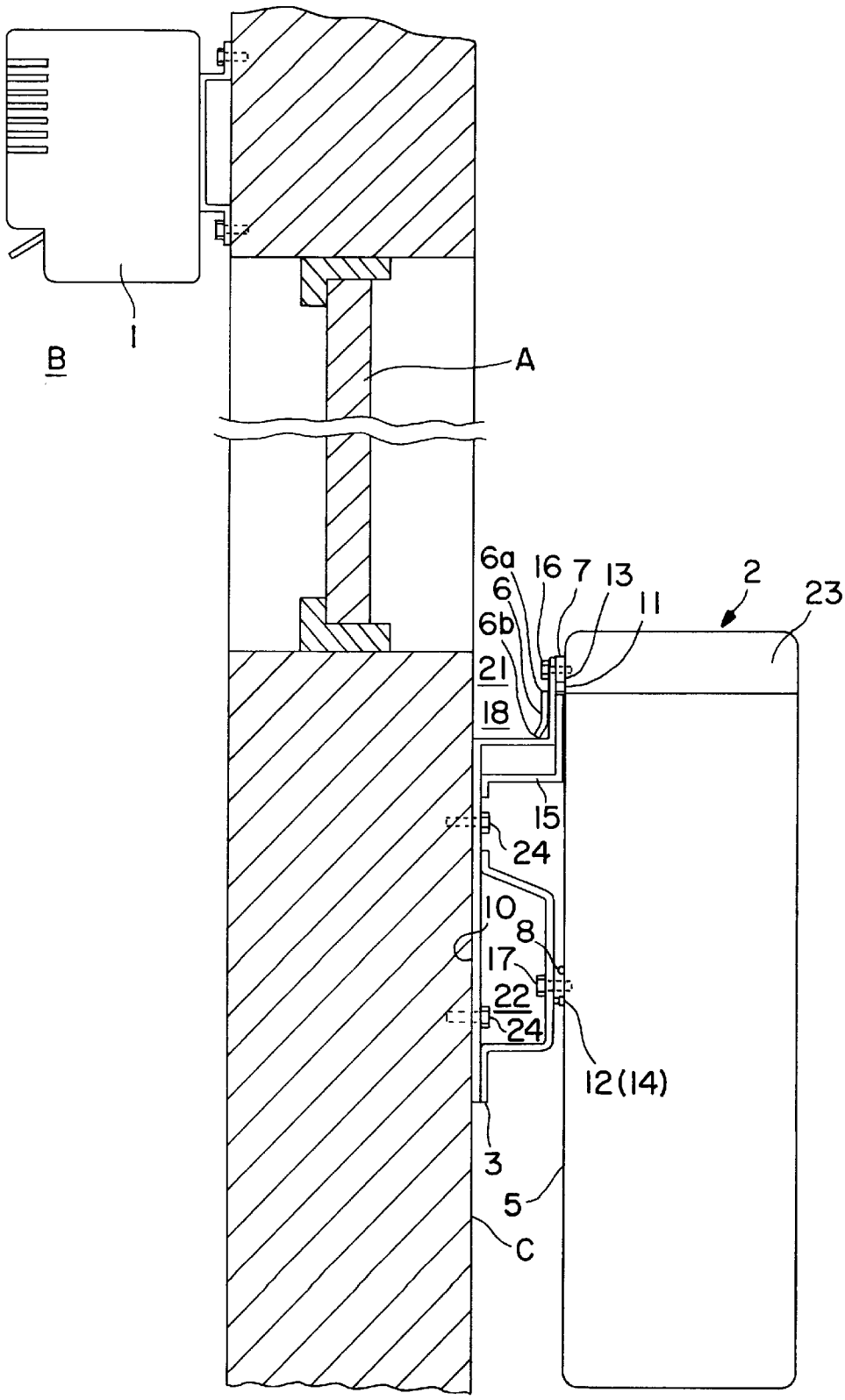
FIG. 2 is a sectional view showing a mode of use of separate type air conditioner of the invention.
Figure 3:
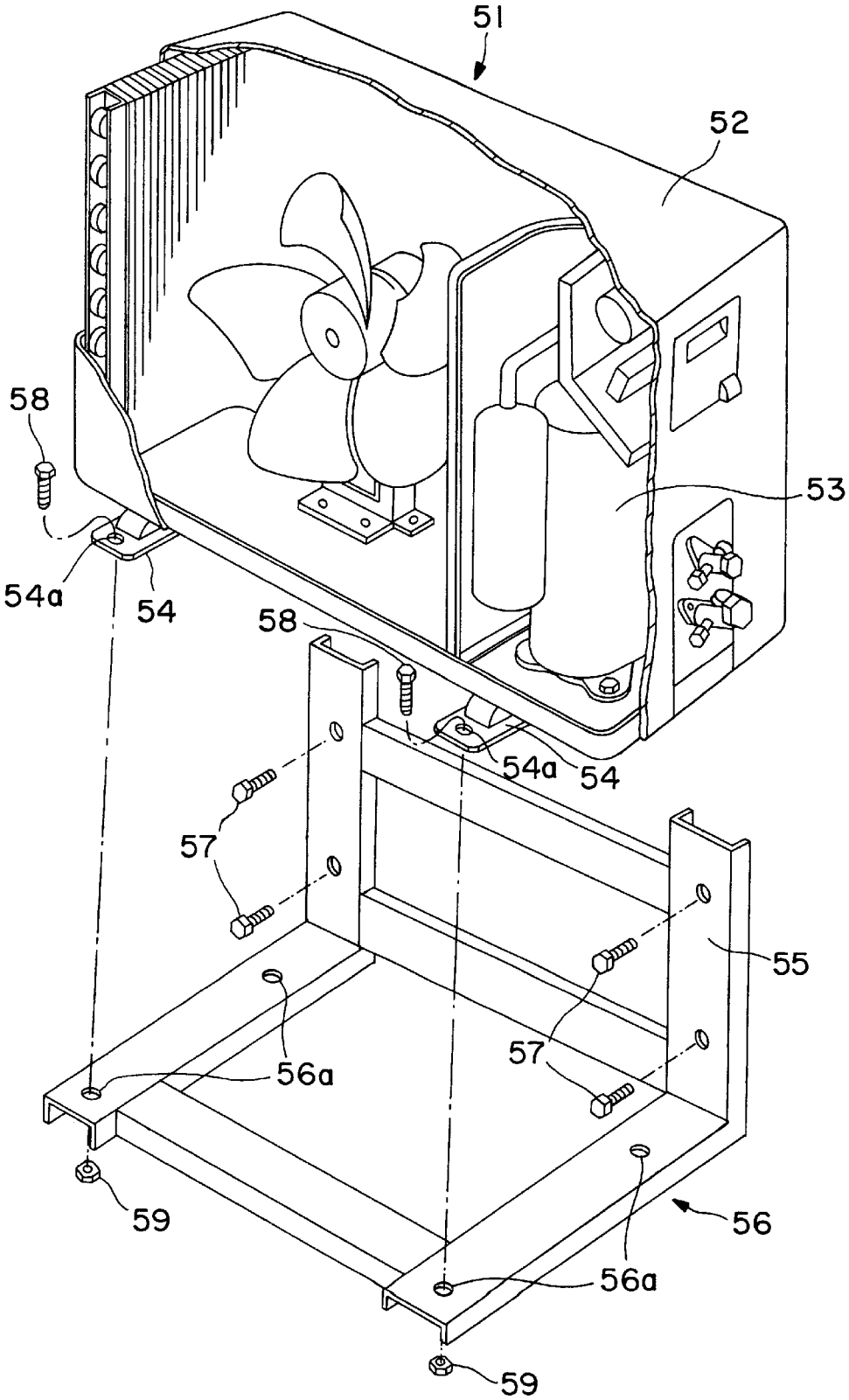
FIG. 3 is a forward perspective view showing a prior art.

An embodiment of a separate type air conditioner of the invention comprises, as shown in FIG. 1 and FIG. 2, an indoor unit 1 installed indoors B, an outdoor unit 2 installed outdoors to cooperate with the indoor unit 1, having a hook 6 released downward provided in the upper part of the back side 5, and an installation member 3 for installing the outdoor unit 2 on an outer wall of a building (hereinafter called wall) C beneath a window A of the building.

The indoor unit 1 is installed indoors B by known means, and is connected to the outdoor unit 2 installed on the outdoor wall C by connection piping and connection wiring not shown in the drawing, and in cooperation with the outdoor unit 2, the indoor unit 1 conditions the indoor air.

The outdoor unit 2 accommodates compressor, fan motor and other heavy objects not shown in the drawing in a box 4. In the upper part of the back side 5 of the box 4, a hook 6 released downward is provided, and this hook 6 supports the whole weight of the outdoor unit 2. To satisfy this requirement, in the embodiment, the hook 6 is formed integrally in the upper part of a relatively thick back plate fitted to the back side 5 of the box 4. Not limited to this, however, other mounting means may be preliminarily provided in the upper part of the back side of the box 4. The central position in the lateral direction of the hook 6 coincides nearly with the position in the lateral direction corresponding to the center of gravity of the outdoor unit 2. Moreover, the hook 6 includes an engaging part 6*a* to be engaged with a holding part 11 of the installation member 3, and a guide part 6*b* extended so that the releasing part may expand toward the releasing end at the leading end of the engaging part 6*a*. At the back side 5, nuts 7 are provided at right and left positions in the upper part, and nuts 8 at right and left positions beneath the hook 6.

In the upper side of the box 4, a ceiling plate 23 is provided, and for minor repair of the outdoor unit 2 after installation, by removing the ceiling plate 23 to open the upper side of the box 4, it is designed to work from within the upper window A without dismounting the outdoor unit 2 from the installation member 3.

The installation member 3 is a metal plate as shown in FIG. 2, and includes a yoke 10 fitted to the wall C with bolts 24, the holding part 11 extended in the lateral direction for having the hook 6 of the outdoor unit 2 engaged with the upper part of the yoke 10 from above and stopping it from beneath, a stopping part 12 provided beneath the holding part 11 of the front side of the yoke 10 for stopping the back side 5 of the outdoor unit 2 at a specified position, and mounting parts 13, 14 for tightening with bolts 16, 17 provided at positions corresponding to nuts 7, 8 of the back side of the outdoor unit 2.

The yoke 10 is fitted to the wall C within a reaching range of hand from the window A by means of four bolts 24.

The holding part 11 is composed of a laterally extended upper side of a metal plate folded upward across a space 18 for leading in the guide part 6*a* at the leading end of the hook 6 of the outdoor unit 2. The holding part 11 is reinforced as the upper part of a reinforcing metal plate 15 is adhered to the holding part 11 and the lower part of the reinforcing metal plate 15 is fitted to the front of the yoke 10, and holding the hook 6, it supports the entire weight of the outdoor unit 2, and it is engaged with the engaging part 7 of the hook 6 to limit the move of the hook 6 in the longitudinal direction. At the right and left outer side of the holding part 11, a mounting part 13 having each metal plate extended further above the holding part 11 is provided, and inside of the mounting part 13, a pair of right and left lateral guides 20 for positioning the hook 6 in the lateral direction are formed, and therefore in engaging operation, the hook 6 is positioned to be received easily, and suspension of a necessary range is assured. In each center of the pair of mounting parts 13, moreover, a mounting hole 13*a* is penetrating. The position of the mounting hole 13*a* is not limited to the upper position of right or left side of the holding part 11 or to the extension from the holding part 11.

The stopping part 12 is made of a pair of right and left metal plates attached to the front side of the yoke 10 by spot welding or the like, and projects forward by the same portion as the holding part 11, and as it abuts against the back side 5 of the outdoor unit 2 at a position beneath the holding part 11, the angular position of the outdoor unit 2 in the longitudinal direction is held in a specified position. Incidentally, the pair of right and left stopping parts 12 also serve as mounting parts 14 by forming mounting holes 14*a* in each front side.

The mounting parts 13, 14 have mounting holes 13*a*, 14*a* of the outdoor unit 2 at the position abutting against the back side 5 of the outdoor unit 2 respectively, communicate with the mounting holes 13*a*, 14*a* by inserting bolts 16, 17 in the space against the wall C, and also have spaces 21, 22 for tightening these bolts 16, 17.

According to the embodiment, as shown in FIG. 2, first, the installation member 3 is attached to the wall C, then the hook 6 in the upper part of the back side 5 of the outdoor unit 2 is put into the holding part 11 in the upper part of the installation member 3 from above to engage with each other to hold by limiting the longitudinal move of the hook 6, and consequently the stopping part 12 beneath the holding part 11 abuts against the back side 5 of the outdoor unit 2 to limit forward tilting of the outdoor unit 2. Finally, by tightening the nuts 7, 8 to the mounting parts 13, 14 of the installation member 3 with bolts 16, 17, the outdoor unit 2 is easily and safely fixed in the wall C within a reaching range of hand from above.

In the embodiment, the lower stopping part 12 serves also as the mounting part 14, but the invention is not limited to this, and the stopping part 12 and mounting part 14 may be provided separately. Although the outdoor unit 2 can be fixed by using either one of the mounting parts 13 and 14, as in the embodiment, by extending the upper mounting part 13 in the lateral direction of the holding part 11, and installing the lower mounting part 14 at the same position as the stopping part 12, the outdoor unit 2 can be fixed firmly while simplifying the structure of the installation member 3.

INDUSTRIAL APPLICABILITY

According to the separate type air conditioner of the invention, first the installation member is fitted to the specified position of the outer wall of the building at its yoke, and it is fitted with bolts, and then the hook in the upper part of the back side of the outdoor unit is engaged with the holding part provided in the upper part of the yoke from above, and therefore the outdoor unit is suspended by the holding part and is not dropped or shaken right or left, and therefore if the position of installation is an elevated place, as far as reached by hand from the window, stairs, verandah, roof top or the like, it is possible to install easily and safely without scaffold or suspending job, and if the outdoor unit is shifted to the back side in the lower part from the holding position of the upper part of the back side, it is stopped at the specified position by the stopping part beneath the holding position of the yoke so as to be stable in an appropriate upright position, so that it can be used as it is without any problem. Besides, the stability of this upright position is higher when the outdoor unit is heavier, which is also an advantage.

When the hook of the outdoor unit is applied in one position in the lateral direction corresponding to the center of gravity of this outdoor unit, the suspending position by this hook and the holding part is the position balanced in weight to the right and left of the outdoor unit, and if suspended at one position only, the anti-deflection rigidity in the yoke plane direction is further enhanced, and a stable installation state is obtained by a simple installation work, and the installation job is easier.

By forming the hook of the outdoor unit so that the releasing part of the hook may be expanded toward the releasing end, the operation of leading the hook into the holding part of the installation member from above is easier, and moreover the engagement of the hook and the holding part at the engagement position is firm.

By forming a mounting hole of the outdoor unit at a position abutting against the back side of the outdoor unit in the installation member, and forming the mounting part having a space for inserting a bolt against the wall to pass through the mounting hole, after installing the outdoor unit as mentioned above, it is easier in the later procedure of bringing the mounting part between them by making use of the space against the wall, passing into the mounting hole of the mounting part, and tightening with screws to the back side of the outdoor unit, and deviation of position and loosening of engagement of the hook and the holding part can be inhibited, and accidental loosening or dropout of installation state of the outdoor unit can be prevented.

What is claimed is:

1. A unit installed to a vertical member, comprising a hanging unit, a hook extending downward from the back side of said hanging unit, and an installation member fitted to the vertical member, said installation member having a holding part for engaging said hook, and further including a stopping part beneath said opening extending horizontally between the back side of said unit and said vertical member, wherein said installation member has a mounting hole through ii which said hanging unit is coupled to said installation member, said installation member forming a space with said vertical member for passing into said mounting hole.

2. A unit installed to a vertical member, comprising a hanging unit, a hook extending downward from the back side of said hanging unit, and an installation member fitted to the vertical member, said installation member having a holding part for engaging said hook, and further including a stopping part beneath said opening extending horizontally between the back side of said unit and said vertical member, wherein said installation member has a mounting hole through which said hanging unit is coupled to said installation member, said installation member forming a space with said vertical member for passing into said mounting hole, and said hook is provided in a position corresponding to the center of gravity of said unit.

3. A unit installed to a vertical member, comprising a hanging unit, a hook extending downward from the back side of said hanging unit, and an installation member fitted to the vertical member, said installation member having a holding part for engaging said hook, and further including a stopping part beneath said opening extending horizontally between the back side of said unit and said vertical member, wherein said installation member has a mounting hole through which said hanging unit is coupled to said installation member, said installation member forming a space with said vertical member for passing into said mounting hole, and said hook of said outdoor unit is formed so that a releasing portion of said hook may be expanded toward a releasing end.

4. A separate type air conditioner comprising:

(a) an indoor unit installed indoors for conditioning indoor air, (b) an outdoor unit installed outdoors accommodating a compressor, said outdoor unit having a hook forming a releasing end projecting downward, provided at a back side thereof, and (c) an installation member for mounting said outdoor unit on an outdoor wall, said installation member including:

(1) a yoke fitted and fixed to said wall, (2) a holding part engaged with said hook for holding said outdoor unit, and (3) a stopping part provided beneath said holding part for engaging said back side of said outdoor unit.

5. A separate type air conditioner of claim 4, wherein said hook is provided in the upper part of said back side.

6. A separate type air conditioner of claim 4, wherein said yoke is fixed to said wall by retaining members.

7. A separate type air conditioner of claim 4, wherein said holding part is extended to right and left, having a through-hole for inserting said hook.

8. A separate type air conditioner of claim 4, wherein said hook is installed in the center of gravity in the lateral direction of said outdoor unit.

9. A separate type air conditioner of claim 4, wherein said hook is expanded toward the releasing end.

10. A separate type air conditioner of claim 4, wherein said stopping part has a first mounting hole, said outdoor unit has a second mounting hole at a position corresponding to said first mounting hole, and said first mounting hole and said second mounting hole are bonded through a bonding member.

11. A separate type air conditioner of claim 4, wherein said stopping part has a first mounting hole, said outdoor unit has a second mounting hole at a position corresponding to said first mounting hole, and a first space capable of joining said first mounting hole and said second mounting hole by inserting a bolt is formed between said stopping part and said yoke.

12. A separate type air conditioner of claim 4, wherein said hook includes an engaging part to be fitted with said holding part, and a guide part formed to expand toward said releasing end.

13. A separate type air conditioner of claim 4, wherein said installation member has a third mounting hole disposed in an upper part thereof, said outdoor unit has a fourth mounting hole at a position corresponding to said third mounting hole, and said third mounting hole and said fourth mounting hole are bonded through a bonding member.

14. A separate type air conditioner of claim 13, wherein said third mounting member is installed in said holding part of said installation member.

15. A separate type air conditioner of claim 4, wherein a second space capable of inserting said releasing end formed downward is formed between said holding part and said yoke.

16. A separate type air conditioner of claim 4, wherein said holding part is disposed projecting from said yoke, said stopping part is disposed projecting from said yoke by a same distance as said holding part, said holding part is fitted to said mounting part, and holds said outdoor unit, and said receiving part abuts against said outdoor unit, and defines the position of said outdoor unit in the longitudinal direction.

17. A separate type air conditioner of claim 4, wherein said installation member further includes a reinforcing member disposed between said holding part and said yoke, and said reinforcing member acts to enhance the strength of said holding part.

18. An installation method of an outdoor unit of separate type air conditioner, comprising the steps of:

(a) supplying an outdoor unit having a hook forming a downward releasing end on a back side thereof, (b) supplying an installation member for installing said outdoor unit on an outdoor wall, said installation member including:

(1) a yoke fixed to said wall, (2) a holding part engaged with said hook for holding said outdoor unit, and (3) a stopping part provided beneath said holding part for receiving said back side of said outdoor unit, (c) fixing said yoke to said wall, (d) fitting said hook to said holding part from above said holding part to hold said outdoor unit on said installation member, and (e) fitting said back side of said outdoor unit to said stopping part to define a move of said outdoor unit in a longitudinal direction.

19. An installation method of outdoor unit of separate type air conditioner of claim 18, wherein said hook is disposed above said back side, and at said step (d) and step (e), said hook is fitted to said holding part from above said holding part to hold said outdoor unit on said installation member, and said back side of said outdoor unit is fitted to said stopping part to define the move of said outdoor unit in the longitudinal direction.

20. An installation method of outdoor unit of separate type air conditioner of claim 18, wherein at step (c), said yoke is fixed to said wall with bolts.

21. An installation method of outdoor unit of separate type air conditioner of claim 18, wherein said hook has an engaging part in a shape expanded laterally, said holding part has a shape expanded laterally, having a through-hole for inserting said hook, and at said step (d), said engaging part is inserted into said through-hole, and said hook and said holding part are joined together.

22. An installation method of outdoor unit of separate type air conditioner of claim 18, wherein said hook is disposed in the center of gravity in the lateral direction of said outdoor unit, and at said step (d), said hook is fitted to said holding part from above said holding part, and said outdoor unit is held on said installation member without allowing inclination to right and left.

23. An installation method of outdoor unit of separate type air conditioner of claim 18, wherein said hook has an engaging part to be fitted to said holding part, and a guide part formed so as to expand toward said releasing end, said holding part has a shape expanded laterally, having a through-hole for inserting said hook, and at said step (d), said guide part is inserted into said through-hole, and said engaging part and said holding part are joined together.

24. An installation method of outdoor unit of separate type air conditioner of claim 18, further comprising:

(f) a step of bonding a first mounting hole disposed in said stopping part and a second mounting hole disposed in said outdoor unit, by means of a bonding member.

25. An installation method of outdoor unit of separate type air conditioner of claim 18, further comprising:

(f) a step of bonding a first mounting hole disposed in said stopping part and a second mounting hole disposed in said outdoor unit, by inserting a first bolt from a first space formed between said stopping part and said yoke, and bonding said first mounting hole and said second mounting hole by means of said first bolt.

26. An installation method of outdoor unit of separate type air conditioner of claim 18, further comprising:

(g) a step of bonding a third mounting hole disposed in said holding part and a fourth mounting hole disposed in said outdoor unit, by means of a bonding member.

27. An installation method of outdoor unit of separate type air conditioner of claim 18, further comprising:

(f) a step of bonding a third mounting hole disposed in said holding part and a fourth mounting hole disposed in said outdoor unit, by inserting a second bolt from a second space formed between said holding part and said yoke, and bonding said third mounting hole and said fourth mounting hole by means of said second bolt.

28. An installation method of outdoor unit of separate type air conditioner of claim 15, wherein said holding part is disposed projecting from said yoke, said stopping part is disposed projecting from said yoke by a same distance as said holding part, and at said step (d) and step (e), said hook is fitted to said holding part from above said holding part to hole said outdoor unit on said installation member, and said back side of said outdoor unit is fitted to said stopping part to define the position of said outdoor unit in the longitudinal direction.

* * * * *

UNITED STATES PATENT AND TRADEMARK OFFICE

CERTIFICATE OF CORRECTION

PATENT NO. : 6,145,334
DATED : November 14, 2000
INVENTOR(S) : Mochizuki et al.

It is certified that error appears in the above-identified patent and that said Letters Patent is hereby corrected as shown below:

Column 5,
Line 39, between "through" and "which" delete "ii".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*